US012193557B2

(12) United States Patent
Lecureuil et al.

(10) Patent No.: US 12,193,557 B2
(45) Date of Patent: Jan. 14, 2025

(54) RECEPTACLE OF A COSMETIC PRODUCT AND REFILL FOR SUCH A RECEPTACLE

(71) Applicant: ALBEA SERVICES, Gennevilliers (FR)

(72) Inventors: Frédéric Lecureuil, Gennevilliers (FR); Mark Edmondson, Gennevilliers (FR)

(73) Assignee: ALBEA SERVICES, Gennevilliers (FR)

( * ) Notice: Subject to any disclaimer, the term of this patent is extended or adjusted under 35 U.S.C. 154(b) by 229 days.

(21) Appl. No.: 17/540,973

(22) Filed: Dec. 2, 2021

(65) Prior Publication Data

US 2022/0346528 A1 Nov. 3, 2022

(30) Foreign Application Priority Data

Apr. 30, 2021 (FR) ..... 2104544

(51) Int. Cl.
*A45D 40/04* (2006.01)
*A45D 40/00* (2006.01)
*A45D 40/16* (2006.01)

(52) U.S. Cl.
CPC ..... *A45D 40/04* (2013.01); *A45D 40/16* (2013.01); *A45D 2040/005* (2013.01); *A45D 2040/0062* (2013.01); *A45D 2200/05* (2013.01)

(58) Field of Classification Search
CPC .. A45D 40/04; A45D 40/16; A45D 2040/005; A45D 2040/0062; A45D 2200/05; A45D 40/00; A45D 40/06; A45D 2040/0031; A45D 2040/204; A45D 2040/208; B65D 83/0005; B65D 83/0011
USPC ..... 401/75, 77, 78, 87
See application file for complete search history.

(56) References Cited

U.S. PATENT DOCUMENTS 5,399,040 A * 3/1995 Holloway ..... A45D 40/06 401/86
5,599,124 A * 2/1997 Ackermann ..... A45D 40/06 401/86
5,649,777 A * 7/1997 Holloway ..... A45D 40/16 401/74

(Continued)

FOREIGN PATENT DOCUMENTS

CN 108523378 A 9/2018
FR 3066081 A1 11/2018

(Continued)

OTHER PUBLICATIONS

FR2104544, "Preliminary Search Report and Written Opinion" with machine translation, Jan. 7, 2022, 13 pages.

(Continued)

*Primary Examiner* — David J Walczak
(74) *Attorney, Agent, or Firm* — Kilpatrick Townsend & Stockton LLP

(57) ABSTRACT

A refill is removably mountable on an actuation base and configured to receive a cosmetic product. The refill includes grooves and/or ribs configured to cooperate respectively with all or part of ribs and/or grooves of the actuation base so as to allow the refill to be mounted on the actuation base to allow an entry and/or an exit of the cosmetic product. To that end, the grooves and/or ribs of the refill extend longitudinally over a part of the height of an internal skirt toward a first end of the refill.

13 Claims, 3 Drawing Sheets

(56) References Cited

U.S. PATENT DOCUMENTS

| | | | | |
|---|---|---|---|---|
| 6,244,770 | B1 * | 6/2001 | Holloway | A45D 40/06 401/78 |
| 11,641,925 | B2 * | 5/2023 | Trochel | A45D 40/12 401/55 |
| 2021/0068517 | A1 | 3/2021 | Trochel | |
| 2021/0093070 | A1 | 4/2021 | Dinata | |

FOREIGN PATENT DOCUMENTS

| | | | |
|---|---|---|---|
| FR | 3074657 | A1 | 6/2019 |
| FR | 3084248 | A1 | 1/2020 |
| GB | 2183220 | A | 6/1987 |
| JP | H0548814 | U | 6/1993 |

OTHER PUBLICATIONS

FR2003229, "Preliminary Search Report and Written Opinion" with machine translation, Oct. 29, 2020, 22 pages.

* cited by examiner

[Fig.1]
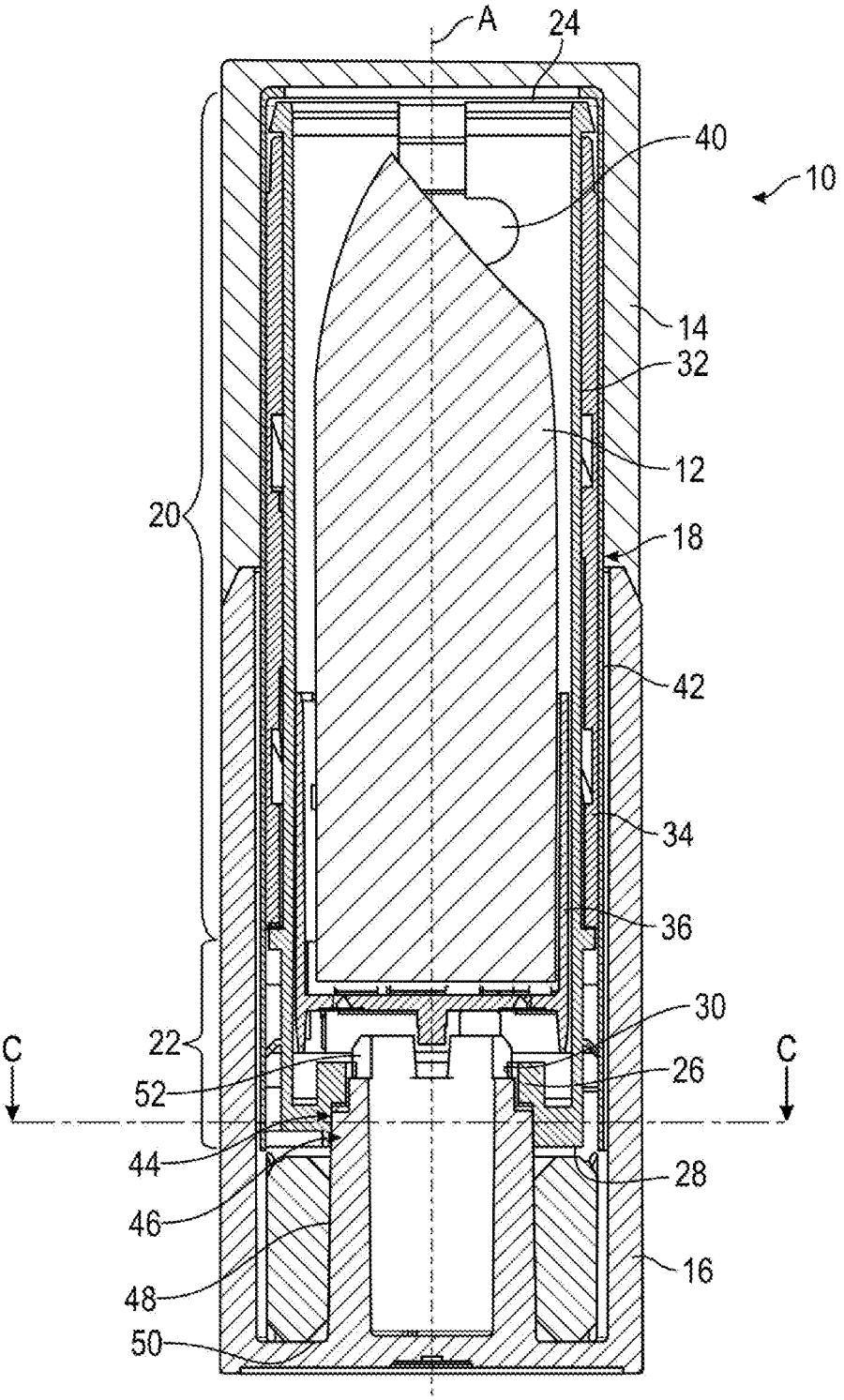

[Fig. 2]
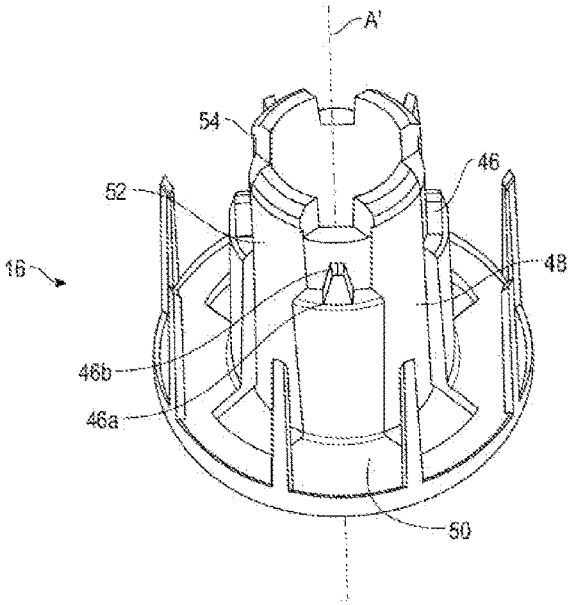
[Fig. 3]
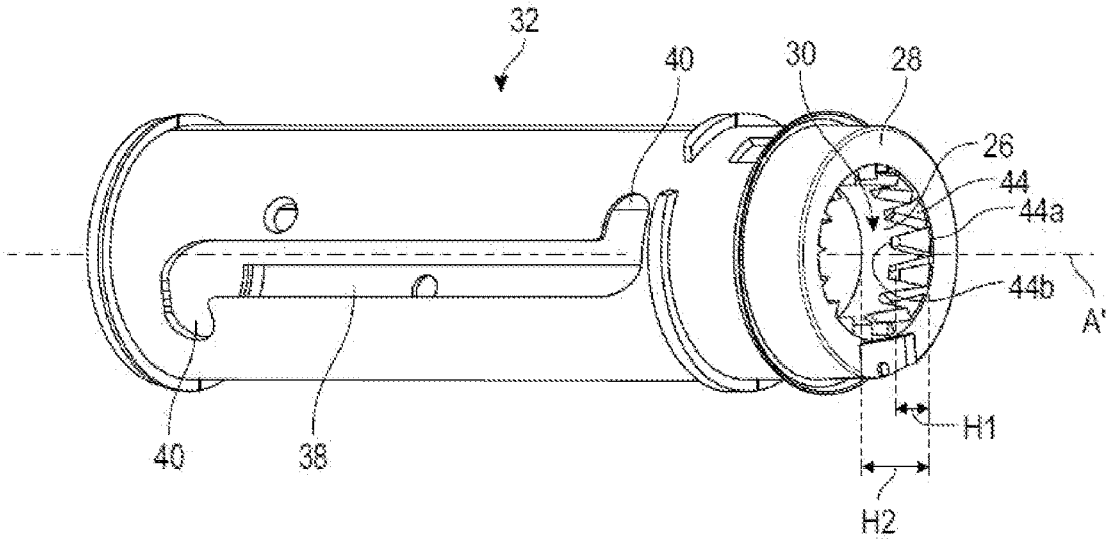
[Fig. 4]
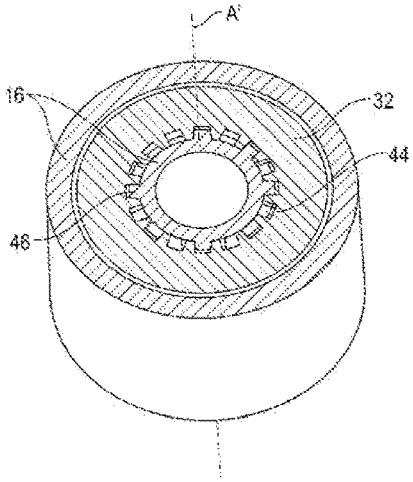

[Fig. 5]
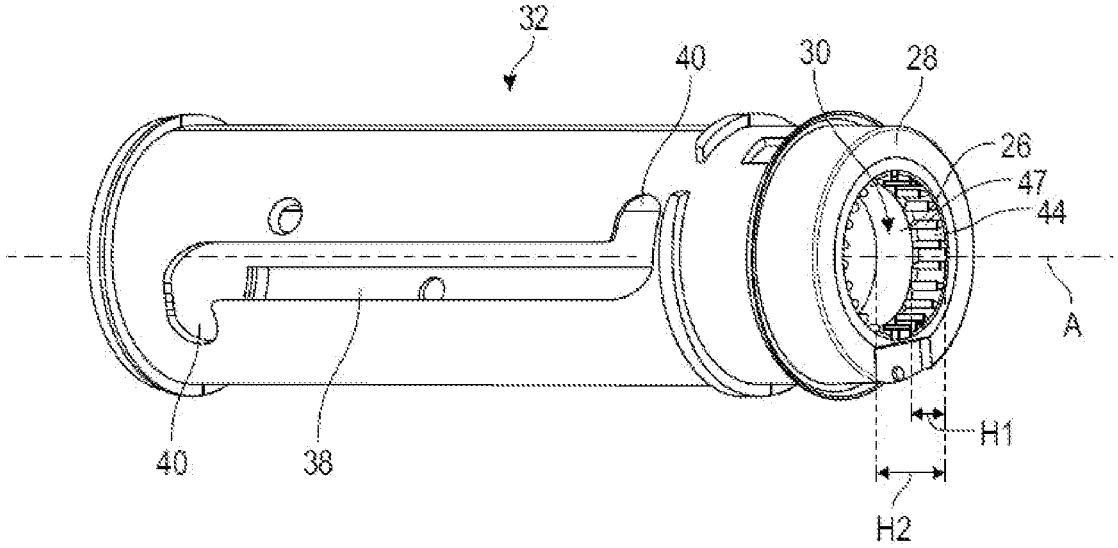

RECEPTACLE OF A COSMETIC PRODUCT AND REFILL FOR SUCH A RECEPTACLE

CROSS REFERENCE TO RELATED APPLICATIONS

This application claims priority under 35 U.S.C. § 119(a) to French patent application number 2104544, filed on Apr. 30, 2021 the entire teachings of which are incorporated herein by reference.

BACKGROUND OF THE INVENTION

Field of the Invention

The invention relates to a refill intended to be removably mounted in a receptacle for cosmetic product, in particular for a stick of cosmetic product, and more particularly to a receptacle for a cosmetic product including at least one such refill

Description of the Related Art

Examples of receptacles for a cosmetic product including a dispensing assembly, referred to as "interchangeable" are known from the prior art.

Compared to a single-use receptacle, such a receptacle is characterized by being refillable, i.e. designed to allow for a change of the dispensing assembly, in particular but not exclusively after a full use of the cosmetic product.

The interchangeability of the dispensing assembly allows to use also, independently of a complete use, a same receptacle with several dispensing assemblies each including, for example, a different cosmetic product such as a lipstick of a given shade.

Such a design allows to keep the cover and the base of the receptacle which is particularly advantageous when these parts are made of precious materials and/or decorated, for example covered with a covering, which by comparison makes them more expensive to manufacture.

In addition, the cover and the base are the visible outer parts of the receptacle that determine the general aesthetics and therefore its originality.

In such a receptacle, the interchangeable dispensing assembly of the cosmetic product constitutes, in particular, a refill or cartridge which can be freely changed.

However, a user in possession of a base may not know which type of refill should be inserted into its receptacle. Similarly, a user in possession of a refill may not know which base it corresponds to.

The insertion of the wrong refill can cause the mechanism to malfunction, which can lead to damage to the mechanism of the base and/or the refill.

There is therefore a need for a solution allowing to solve at least some of the disadvantages of the prior art while maintaining an assembly that is interchangeable and advantageously simple and economical to manufacture.

BRIEF SUMMARY OF THE INVENTION

The present invention relates to a refill intended to be removably mounted on an actuation base and configured to receive a cosmetic product and having a main axis, the refill including a cup configured to receive the product and including at least one lug, a guide including at least one slide in which the at least one lug of the cup slides, a sheath arranged around the guide and including at least one helical groove with which the at least one lug of the cup cooperates to allow an entry and/or an exit of the cosmetic product.

The refill has a first portion including a first end provided with an opening through which the cosmetic product exits and a second opposite portion inaccessible to the user when the refill is mounted on the actuation base.

The second portion is provided with an internal skirt extending longitudinally towards the first end of the refill.

The internal skirt has an internal surface directed towards the interior of the refill and including a plurality of grooves and/or ribs.

The grooves and/or ribs of the internal skirt are configured to cooperate respectively with all or part of a plurality of ribs and/or grooves of the actuation base so as to allow the refill to be mounted on the actuation base to allow an entry and/or an exit of the cosmetic product.

According to the invention, the grooves and/or ribs of the internal skirt of the refill extend longitudinally on the internal surface of the internal skirt of the refill over a part of the height of the internal skirt.

By "allowing the refill to be mounted on the actuation base to allow an entry and/or exit of the cosmetic product" is meant a complete mounting and not a partial association which could be sufficient to actuate the refill under non-nominal conditions, i.e., in particular, without fixing the refill on the base. In other words, the mechanism of entry and/or exit of the cosmetic product can only be activated if the refill is correctly associated in the base, this being possible only if the ribs and/or grooves of the base correspond respectively to the grooves and/or ribs of the refill. This allows, in particular, to avoid a deterioration of the mechanism of entry and/or exit of the cosmetic product in the case of a not adapted refill, not compatible with the base. This allows to ensure the uniqueness and a functional control of the product.

Furthermore, the grooves and/or ribs of the refill extend over only a partial height of the internal skirt of the refill allowing an axial stop so as to avoid an assembly of the refill on a wrong base and a deterioration of one and/or the other.

There is thus a radial (distribution of the grooves and/or ribs) and axial (in height) cooperation between the refill and the base.

According to various embodiments of the invention, which may be taken together or separately:

- the cosmetic product is a stick of cosmetic product,
- the grooves and/or ribs of the internal skirt of the refill have a height,
- the internal skirt of the refill has a height,
- the grooves and/or ribs of the internal skirt of the refill extend such that the height of the grooves and/or ribs of the internal skirt of the refill is between 10 and 90% of the height of the internal skirt of the refill,
- the grooves and/or ribs of the internal skirt of the refill extend in a manner that the height of the grooves and/or ribs of the internal skirt is between 40 and 60% of the height of the internal skirt of the refill,
- the grooves and/or ribs of the internal skirt of the refill extend in a manner that the height of the grooves and/or ribs of the internal skirt of the refill is 50% of the height of the internal skirt of the refill,
- the height of the internal skirt of the refill is constant over its entire circumference,
- the height of the internal skirt of the refill is variable over its entire circumference,
- the height of the grooves and/or ribs of the internal skirt of the refill is constant over the entire circumference of the internal skirt of the refill, the height of the grooves and/or ribs of the internal skirt of the refill is variable over the entire circumference of the internal skirt of the refill, the internal skirt of the refill extends longitudinally from a transverse bottom of the refill towards the interior of the refill, the grooves and/or ribs of the internal skirt cooperating and associating respectively with ribs and/or grooves of the base are angularly distributed in a regular manner, the grooves and/or ribs of the internal skirt cooperating and associating with respective ribs and/or grooves of the base are angularly distributed in an irregular manner, the grooves and/or ribs of the internal skirt of the refill are configured such that all or part of the latter and the ribs and/or grooves of the base are inserted into each other, the grooves and/or ribs of the internal skirt of the refill are configured to be associated respectively with all or part of the ribs and/or grooves of the actuation base according to a single configuration so as to allow the refill to be mounted on the actuation base to allow the entry and/or the exit of the cosmetic product, the grooves and/or ribs of the internal skirt of the refill include walls extending parallel to the main axis of the refill, the grooves and/or ribs of the internal skirt of the refill extend longitudinally from a wide base to a narrow end, the grooves of the internal skirt are blind grooves, some or all of the grooves and/or ribs of the internal skirt are further configured to cooperate with the ribs and/or grooves of the base respectively to ensure a rotational lock provided to rotatably link the refill and the base, the refill further includes a shell that is integral in rotation with the sheath, the shell extends along the entire length of the guide, the refill includes an actuation mechanism allowing the entry and/or the exit of the cosmetic product, the actuation mechanism is operable only when the refill is inserted on the actuation base, the refill includes alternative or complementary attachment means which allow the refill to be axially linked to the base, the attachment means are formed by one or more elements different from the grooves and/or ribs of the internal skirt of the refill, the attachment means are formed by the internal skirt, for example configured to cooperate with flexible legs of the base, the grooves and/or ribs of the internal skirt cooperating and associating with respectively ribs and/or grooves of the base are arranged according to a customized manner so that the refill is attributable to a single type of base, the arrangement of the grooves and/or ribs of the internal skirt cooperating and associating with respectively ribs and/or grooves of the base is configurable by a user.

The invention also relates to a receptacle for cosmetic product, including a refill as described above and a corresponding actuation base allowing an entry and/or an exit of the cosmetic product, the refill being configured to be removably mounted on the actuation base.

According to the invention, the actuation base includes ribs and/or grooves configured to cooperate with all or part of the grooves and/or ribs when the refill is mounted on the actuation base so as to allow the refill to be mounted on the actuation base and to allow an entry and/or an exit of the cosmetic product.

According to various embodiments of the invention, which may be taken together or separately:

the receptacle includes a cover, the ribs and/or grooves of the actuation base are complementary to the grooves and/or ribs of the internal skirt of the refill with which they cooperate and associate, the ribs and/or grooves of the base are complementary in shape to the shape of the grooves and/or ribs, respectively, of the internal skirt of the refill with which they cooperate and associate, the ribs and/or grooves of the base are complementary in dimensions to the dimensions of the grooves and/or ribs, respectively, of the internal skirt of the refill with which they cooperate and associate, the ribs and/or grooves of the base are angularly distributed in a regular manner, the grooves and/or ribs of the base extend longitudinally from a wide base to a narrow end, the grooves of the base are blind grooves, the base includes at least one attachment means for axially linking the actuation base with the refill, the attachment means are formed by one or more elements different from the ribs and/or grooves of the base, the length of the attachment means and the height of the internal skirt of the refill are defined in such a way that the at least one attachment means only engages if there is a shape cooperation between the ribs and/or the grooves of the actuation base and all or part respectively of the grooves and/or ribs of the refill.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein:

FIG. 1 is an axial cross-sectional view showing a receptacle after mounting a refill according to the invention on an actuation base of the receptacle;

FIG. 2 is a perspective top view of a part of the base of FIG. 1 according to a first example embodiment;

FIG. 3 is a perspective view of the guide of the refill of FIG. 1 according to a first example embodiment;

FIG. 4 is a C-C cross-sectional view of the receptacle of FIG. 1 showing the guide and the base according to a first example embodiment;

FIG. 5 is a perspective view of the guide of the refill of FIG. 1 according to a second example embodiment.

DETAILED DESCRIPTION OF THE INVENTION

By convention, the "axial" direction corresponds to the main extension direction of the receptacle 10, illustrated by the axis A in the figures, and the "radial" direction is orthogonal to the axial direction.

In the following detailed description of the figures, the terms "upper" and "lower" or "top" and "bottom" will be used without limitation in reference to the axial direction.

Similarly, the terms "outer or external" and "inner or internal" are used with reference to the radial direction, an outer element being radially further from the axis A than an inner member.

In the following description, elements with identical structure or similar functions will be designated by same references.

FIG. 1 shows an example embodiment of a receptacle 10, also referred to as a case, for a cosmetic product.

In the example embodiment, the cosmetic product is a stick 12 of cosmetic product and, more particularly, the stick 12 of cosmetic product is a lipstick stick 12 intended to be applied by friction, alternatively a lip care balm.

The receptacle 10 includes at least one cover 14 which is associated with a complementarily shaped actuation base 16, the base 16 and the cover 14 together defining an external outline of the receptacle 10.

The receptacle 10 further includes a refill 18 for dispensing the stick 12 of cosmetic product.

In a non-limiting manner, the cover 14, the base 16 of the receptacle 10 and the refill 18 have a cylindrical shape with a circular section.

Preferably, the cover 14 is removable. The cover 14 is adapted to occupy at least one open position in which the cover 14 is separated from the base 16 in order to in particular allow the cosmetic product to be applied, and a closed position in which the cover 14 is integral with the base (FIG. 1).

Maintaining the cover 14 in the closed position allows a sealed closure to be obtained in order to guarantee a good conservation of the stick 12 of cosmetic product, during use of the refill 18.

The refill 18 is intended to be removably mounted on an actuation base 16, for example the base 16 of the cosmetic product receptacle 10 described above.

The refill 18 is intended to be changeable, in particular but not exclusively after the stick 12 of cosmetic product has been fully used.

The refill 18 and its mechanism for entering and/or exiting the stick 12 of cosmetic product described below are only given as a non-limiting example.

The refill 18 has a main axis A' which extends in the axial direction, coincident with the main axis A of the receptacle 10.

The refill 18 has a first portion 20 including a first end provided with an opening 24 through which the cosmetic product exits and an opposite second portion 22 inaccessible to the user when the refill 18 is mounted on the actuation base 16.

The second portion 22 is provided with an internal skirt 26 which extends, projects longitudinally from a transverse bottom 28 of the refill 18 towards the first end of the refill 18 and which has an internal surface 30 directed towards the interior of the refill 18.

In the example embodiment, the refill 18 includes a guide 32, the rotation of which relative to a sheath 34 causes an axial movement of a cup 36 carrying the stick 12 of cosmetic product.

The guide 32, the sheath 34 and the cup 36 form an actuation mechanism of the refill 18 allowing an entry and/or an exit of the stick 12 of cosmetic product.

The cup 36 includes at least one lug (not shown), preferably two diametrically opposed lugs.

The lugs cooperate respectively with slides 38 of the guide 32, the slides 38 extending axially in a rectilinear manner. Each slide 38 advantageously includes, at each of its upper and lower ends, an angular indentation 40 forming an end-of-travel stop for the lugs of the cup 36.

The sheath 34 surrounds the guide 32. The sheath 34 includes internally two helical grooves (not shown) with which the free end of the lugs respectively cooperate, each lug passing radially through the associated slide 38 of the guide 32 to engage in a groove.

The refill 18 here further includes a shell 42, also referred to as sleeve or jacket, which is mounted in force or glued to the exterior of the sheath 34, and is rotationally integral with the sheath 34. Advantageously, the shell 42 is metallic, for example aluminum.

In other embodiments not shown, the refill may not include a shell.

In the receptacle shown in FIG. 1, the shell 42 extends over the entire length of the guide 32 and thus covers the bottom part of the guide 32. The shell 42 is thus extended in a manner so that the actuation mechanism is inaccessible to the user before the refill 18 is installed in the receptacle 10. The actuation mechanism cannot be actuated without the use of an external element, such as the actuation base 16 of the receptacle 10.

The rotation of the guide 32 causes, depending on the direction of rotation, an axial upward or downward movement of the cup 36 and thus of the stick 12 of cosmetic product.

Optionally, the guide 32 may include a knob located axially at the lower end of the guide 32 and allowing the rotation of the guide 32.

Preferably, the knob is made in one piece with the guide 32 of the refill 18.

Alternatively, the knob is a separate part fitted to attachment to the guide 32.

In such a receptacle 10, the actuation mechanism of the refill 18 is actuated, after previously removing the cover 14, by means of the base 16.

Therefore, the refill 18, here the guide 32, and the base 16 must on the one hand be axially connected together and on the other hand be rotationally linked to ensure the transmission to the refill 18 of any rotational movement applied to the base 16.

To do this, the refill 18 must be correctly inserted in the correct base 16.

This is particularly the case, for refills 18, such as the one shown here, for which the actuation mechanism is operable only when the refill 18 is inserted on the corresponding actuation base 16.

Thus, according to the invention, the internal surface 30 of the internal skirt 26 of the refill 18 includes a plurality of grooves 44 and/or ribs that extend longitudinally across the internal surface 30 of the internal skirt 26 of the refill 18.

The grooves 44 and/or ribs extend, in particular, over a part of the height of the internal skirt 26, here from the transverse bottom 28 of the refill 18 towards the first end of the refill 18.

Thus, the grooves 44 and/or ribs of the refill 18 do not extend over the full height of the internal skirt 26 of the refill 18. In other words, only a part of the height of the internal skirt 26 of the refill 18 includes grooves 44 and/or ribs.

Thus, the grooves 44 and/or ribs of the internal skirt 26 of the refill 18 have a height H1 less than a height H2 of the internal skirt 26 of the refill 18.

Advantageously, the grooves 44 and/or ribs of the internal skirt 26 of the refill 18 extend such that the height H1 of the grooves 44 and/or ribs of the internal skirt 26 of the refill 18 is between 10 and 90% of the height H2 of the internal skirt 26 of the refill, preferably between 40 and 60% of the height H2 of the internal skirt 26 of the refill 18, even more preferably 50% of the height H2 of the internal skirt 26 of the refill 18.

The height H2 of the internal skirt 26 of the refill 18 and the height H1 of the grooves 44 and/or ribs of the internal skirt 26 of the refill 18 may be constant or variable around the circumference of the internal skirt 26 of the refill 18.

In the example embodiments shown herein, the height H2 of the internal skirt 26 of the refill 18 and the height H1 of the grooves 44 and/or ribs of the internal skirt 26 of the refill 18 are constant over the entire circumference of the internal skirt 26 of the refill 18, and the height H1 of the grooves 44 and/or ribs of the internal skirt 26 of the refill 18 extends over approximately 50% of the height H2 of the internal skirt 26 of the refill 18.

The grooves 44 and/or ribs of the internal skirt 26 are configured to cooperate respectively with all or part of a plurality of ribs 46 and/or grooves of the actuation base 16 so as to allow the refill 18 to be mounted on the actuation base 16 to allow an entry and/or an exit of the cosmetic product.

Some or all of the grooves 44 and/or ribs of the internal skirt 26 of the refill 18 are configured to be respectively associated with ribs 46 and/or grooves of the base 16 according to a single configuration.

The grooves 44 and/or ribs of the internal skirt 26 of the refill 18 cooperating and associating with ribs 46 and/or grooves of the base 16, respectively, are referred to as identification grooves 44 and/or ribs of the refill 18.

Optionally, the internal skirt 26 of the refill 18 also includes grooves 44 and/or ribs not cooperating and not associating respectively with ribs 46 and/or grooves of the base 16, as shown in the example embodiment illustrated in FIGS. 1 to 4.

Preferably, all the ribs 46 and/or grooves of the base 16 cooperate and associate with grooves 44 and/or ribs, respectively, of the internal skirt 26 of the refill 18.

Advantageously, the cooperation and the association of the grooves and the ribs of the refill 18 and of the base 16 allow the refill 18 and the base 16 to be axially and rotatably connected to ensure that any rotational movement applied to the base 16 is transmitted to the knob of the refill 18.

Thus, the rotation, here, of the guide 32 causes, depending on the direction of rotation, an axial upward or downward movement of the cup 36 and thus of the stick 12 of cosmetic product.

In both illustrated example embodiments, the internal skirt 26 of the refill 18 including the identification grooves 44 and/or ribs is made in single piece with the guide 32. In other words, the internal skirt 26 and the guide 32 are in one piece.

Alternatively, the internal skirt 26 is a separate piece fitted to attachment to the guide 32.

Advantageously, in the illustrated example embodiments, the internal skirt 26 of the refill 18 includes only grooves 44 and the actuation base 16 includes only ribs 46.

In the first example embodiment shown in FIGS. 2 to 4, the internal skirt 26 of the refill 18 includes sixteen angularly contiguous grooves 44 evenly distributed over the entire circumference of its internal surface 30, on a bottom part of the internal skirt 26, i.e. close to the transverse bottom 28 of the guide 32.

The grooves 44 extend longitudinally from a wide base 44*a* to a narrow closed end 44*b*. In other words, the grooves 44 of the internal skirt 26 are blind, not open.

The grooves 44 are, in this first example embodiment, triangular in shape, more precisely an isosceles triangle the base 44*a* of which is located at the level of the transverse bottom 28 of the guide 32 and the main apex 44*b* is rounded and points towards the first end of the refill 18. Each of the bases 44*a* of the triangular ribs 46 is contiguous with, adjoins two other bases 44*a* so as to cover the entire periphery of the internal surface 30 of the internal skirt 26 of the refill 18.

In the second example embodiment shown in FIG. 5, the internal skirt 26 of the refill 18 includes twenty-four angularly contiguous grooves 44 evenly distributed around the entire periphery of its internal surface 30, on a lower part of the internal skirt 26, i.e., near the transverse bottom 28 of the guide 32.

The grooves 44 include walls extending parallel to the main axis A of the refill 18.

The walls are formed by protrusions 47 of material projecting from the internal surface 30 of the internal skirt 26 of the refill 18 and extending longitudinally and parallel to each other and to the main axis A.

In other words, they are straight, not open grooves parallel to each other and to the main axis A.

In the illustrated example embodiments, the actuation base 16 includes an internal skirt 48 a wall of which extends from a transverse bottom 50 toward the first end of the refill 18 when the refill 18 is inserted into the actuation base 16.

Advantageously, the wall of the internal skirt 48 of the actuation base 16 is composed of four legs 52 serving as attachment means which allow the actuation base 16 to be axially linked to the refill 18, here to the guide 32.

The four legs 52 of the actuation base 16 are evenly angularly distributed at 90°. The legs 52 may be inserted into a centrally disposed complementary orifice defined by the internal skirt 26 of the refill 18 upon mounting the refill 18 on the actuation base 16. Advantageously, the legs are flexible.

The free end of each leg 52 is configured to form a hook 54 which cooperates with an upper edge of an orifice formed by the internal skirt 26 of the guide 32 to axially lock the actuation base 16.

Between each of the legs 52, the external surface of the internal skirt of the actuation base 16 includes ribs 46 that cooperate and associate with grooves 44 of the internal skirt 26 of the refill 18, here of the guide 32.

In the first example embodiment, the external surface of the internal skirt of the actuation base 16 includes four ribs 46 which cooperate and associate with four other grooves 44 of the internal skirt 26 of the refill 18, here of the guide 32.

The ribs 46 are evenly angularly distributed at 90° on the periphery of the external surface of the internal skirt of the actuation base 16.

Advantageously, the ribs 46 of the actuation base 16 have a shape and dimensions complementary to those of the grooves 44 of the refill 18.

Thus, in this first example embodiment, the ribs 46 extend longitudinally from a wide base 46*a* to a narrow end 46*b*.

The ribs 46 are here triangular in shape, more precisely an isosceles triangle the base 46*a* of which is located at the level of the transverse bottom 50 of the actuation base 16 and the main apex 46*b* is rounded and points towards the first end of the refill 18.

The ribs 46 of the actuation base 16 are configured to associate with and fit within the grooves 44 of the refill 18 as seen in FIG. 4.

The refill 18 can only be properly inserted into the actuation base 16 if the number, the size, the distribution of the ribs 46 of the actuation base 16 and of the grooves 44 of the refill 18 match.

Advantageously, the particular shape of the grooves 44 and/or ribs of the refill 18 and of the actuation base 16 of the first example embodiment, i.e., an elongated shape of wide base and narrow end, allows the refill 18 to be easily mounted on the actuation base 16.

Indeed, the insertion of the narrow end 46*b* of the rib 46 of the actuation base 16 into a groove 44 of the refill 18 is facilitated by the width of the base 44*a* of the groove 44 and guided by the walls thereof until the final assembly of the refill 18 into the actuation base 16.

In both of these example embodiments, the grooves/ribs system also allows the refill 18 to be rotationally locked with respect to the actuation base 16 so as to rotatably link the actuation base 16 and the receptacle 10.

Also, advantageously, the legs 52 are configured such that they engage with the refill 18 only if the grooves 44 and/or ribs of the refill 18 correspond to the ribs 46 and/or grooves of the actuation base 16, respectively.

Preferably, the length of the attachment means, here of the legs 52 and the height of the internal skirt 26 of the refill 18 are defined such that the at least one attachment means only engages if there is a form-fit cooperation between the ribs 46 and/or grooves of the actuation base 16 and all or part respectively of the grooves 44 and/or ribs of the refill 18.

The distribution, the number, the shape and the dimensions of the ribs and/or grooves of the actuation base 16 and/or of the refill 18 can thus be customized so that the refill 18 is attributable to a unique type of actuation base 16, and vice versa.

All possible regular or irregular distributions of the grooves and/or ribs can be considered as long as they ensure a unique combination.

The refill 18 and the actuation base 16 have a visual signature similar to a barrel due to the grooves and/or ribs.

In the illustrated examples, the refill 18 includes grooves 44 and the actuation base 16 includes ribs 46. It should be noted that, conversely, the grooves can be on the actuation base 16 and the ribs on the refill 18. Generally speaking, a groove is any type of indentation, notch and/or slot that can cooperate with the corresponding rib.

Of note, the terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "includes", and/or "including," when used in this specification, specify the presence of stated features, integers, steps, operations, elements, and/or components, but do not preclude the presence or addition of one or more other features, integers, steps, operations, elements, components, and/or groups thereof.

As well, the corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Having thus described the invention of the present application in detail and by reference to embodiments thereof, it will be apparent that modifications and variations are possible without departing from the scope of the invention defined in the appended claims as follows:

The invention claimed is:

1. A refill intended to be removably mounted on an actuation base and configured to receive a cosmetic product and having a main axis, said refill comprising a cup configured to receive said product and comprising:

at least one lug, a guide comprising at least one slide in which said at least one lug of the cup slides, a sheath arranged around the guide and comprising at least one helical groove with which the at least one lug of the cup cooperates to allow an entry and/or an exit of the cosmetic product, the refill having a first portion comprising a first end provided with an opening through which the cosmetic product exits and a second opposite portion inaccessible to a user when the refill is mounted on the actuation base, the second portion being provided with an internal skirt extending longitudinally towards the first end of the refill, said internal skirt having an internal surface directed towards an interior of the refill and comprising a plurality of grooves and/or ribs, the grooves and/or ribs of the internal skirt being configured to cooperate respectively with all or part of a plurality of ribs and/or grooves of the actuation base so as to allow the refill to be mounted on the actuation base to allow the entry and/or the exit of the cosmetic product, the grooves and/or ribs of the internal skirt of the refill extending longitudinally on the internal surface of the internal skirt of the refill over a part of a height of the internal skirt, wherein the refill further comprises a shell that is integral in rotation with the sheath and extending along the entire length of the guide.

2. The refill according to claim 1, wherein the grooves and/or ribs of the internal skirt of the refill have a height, the grooves and/or ribs of the internal skirt of the refill extending such that the height of the grooves and/or ribs of the internal skirt of the refill is 50% of the height of the internal skirt of the refill.

3. The refill according to claim 1, wherein the internal skirt of the refill extends longitudinally from a transverse bottom of the refill towards the interior of the refill.

4. The refill according to claim 1, wherein the grooves and/or ribs of the internal skirt of the refill are configured for cooperating and associating respectively with ribs and/or grooves of the actuation base are angularly distributed in a regular manner.

5. The refill according to claim 1, wherein the grooves and/or ribs of the internal skirt of the refill are configured to be associated respectively with all or part of the ribs and/or grooves of the actuation base according to a single configuration so as to allow the refill to be mounted on the actuation base to allow the entry and/or the exit of the cosmetic product.

6. The refill according to claim 1, wherein the grooves and/or ribs of the internal skirt of the refill comprise walls extending parallel to the main axis of the refill.

7. The refill according to claim 1, wherein the grooves and/or ribs of the internal skirt of the refill extend longitudinally from a wide base to a narrow end.

8. The refill according to claim 1, wherein the grooves of the internal skirt are blind grooves.

9. The refill according to claim 1, wherein some or all of the grooves and/or ribs of the internal skirt are further configured to cooperate with the ribs and/or grooves of the actuation base respectively to ensure a rotational lock provided to rotatably link the refill and the actuation base.

10. A receptacle for a cosmetic product, comprising:

a refill comprising a cup configured to receive said product and comprising:

at least one lug, a guide comprising at least one slide in which said at least one lug of the cup slides, a sheath arranged around the guide and comprising at least one helical groove with which the at least one lug of the cup cooperates to allow an entry and/or an exit of the cosmetic product, the refill having a first portion comprising a first end provided with an opening through which the cosmetic product exits and a second opposite portion inaccessible to a user when the refill is mounted on an actuation base, the second portion being provided with an internal skirt extending longitudinally towards the first end of the refill, said internal skirt having an internal surface directed towards an interior of the refill and comprising a plurality of grooves and/or ribs, the grooves and/or ribs of the internal skirt being configured to cooperate respectively with all or part of a plurality of ribs and/or grooves of the actuation base so as to allow the refill to be mounted on the actuation base to allow the entry and/or the exit of the cosmetic product, the grooves and/or ribs of the internal skirt of the refill extending longitudinally on the internal surface of the internal skirt of the refill over a part of a height of the internal skirt, wherein the refill further comprises a shell that is integral in rotation with the sheath and extending along the entire length of the sheath, the receptacle further comprising the actuation base allowing an entry and/or an exit of the cosmetic product, said refill being configured to be removably mounted on the actuation base, said actuation base comprising ribs and/or grooves configured to cooperate with all or part of the grooves and/or ribs when the refill is mounted on the actuation base so as to allow the refill to be mounted on the actuation base and allow the entry and/or the exit of the cosmetic product.

11. The receptacle according to claim 10, wherein the ribs and/or grooves of the actuation base are of complementary shape and/or dimensions to a shape and/or dimensions respectively of the grooves and/or ribs of the internal skirt of the refill with which they cooperate and associate.

12. The receptacle according to claim 10, wherein the ribs and/or grooves of the actuation base are angularly distributed in a regular manner.

13. The receptacle according to claim 10, wherein the actuation base comprises at least one attachment means for axially linking the actuation base with the refill, said attachment means being formed by one element or elements different from the ribs and/or grooves of the actuation base.

* * * * *